US009679759B2

(12) United States Patent
Xiong et al.

(10) Patent No.: US 9,679,759 B2
(45) Date of Patent: Jun. 13, 2017

(54) TYPE RECTANGULAR ION TRAP DEVICE AND METHOD FOR ION STORAGE AND SEPARATION

(71) Applicant: NATIONAL INSTITUTE OF METROLOGY, CHINA, Beijing (CN)

(72) Inventors: Xingchuang Xiong, Beijing (CN); You Jiang, Beijing (CN); Zejian Huang, Beijing (CN); Xiang Fang, Beijing (CN)

(73) Assignee: National Institute of Metrology, China, Beijing (CN)

( * ) Notice: Subject to any disclaimer, the term of this patent is extended or adjusted under 35 U.S.C. 154(b) by 0 days.

(21) Appl. No.: 15/100,817

(22) PCT Filed: Aug. 15, 2014

(86) PCT No.: PCT/CN2014/084467

§ 371 (c)(1),
(2) Date: Jun. 1, 2016

(87) PCT Pub. No.: WO2016/023215

PCT Pub. Date: Feb. 18, 2016

(65) Prior Publication Data

US 2016/0293396 A1 Oct. 6, 2016

(51) Int. Cl.
*H01J 49/00* (2006.01)
*H01J 49/42* (2006.01)

(52) U.S. Cl.
CPC ..... *H01J 49/4225* (2013.01); *H01J 49/4295* (2013.01)

(58) Field of Classification Search
CPC .. H01J 49/00; H01J 49/02; H01J 49/06; H01J 49/062; H01J 49/063; H01J 49/065;
(Continued)

(56) References Cited

U.S. PATENT DOCUMENTS 6,469,298 B1 * 10/2002 Ramsey ..... H01J 49/0018 250/281
6,838,666 B2 1/2005 Ouyang et al.
(Continued)

FOREIGN PATENT DOCUMENTS

CN 101017762 A 8/2007
CN 101038852 A 9/2007
(Continued)

*Primary Examiner* — Jason McCormack
(74) *Attorney, Agent, or Firm* — Muncy, Geissler, Olds & Lowe, P.C.

(57) ABSTRACT

The present invention discloses a rectangular ion trap device and method for ion storage. The device comprises a front end cover including left electrode, middle layer insulator, and right electrode, wherein the left electrode and the right electrode are respectively positioned at both sides of the middle layer insulator; a rear end cover, wherein the rear end cover has the same axis as the front end cover, and the central position of the rear end cover electrode is penetrated; the front and rear electrodes and the upper and lower electrodes are symmetric along the axis of the front end cover, and these electrodes form a space region for ion storage about the axis between the front end cover and the rear end cover electrode. The present invention can increase the number of ions in storage within a unit time prominently.

14 Claims, 9 Drawing Sheets

(58) Field of Classification Search
CPC ..... H01J 49/067; H01J 49/068; H01J 49/26; H01J 49/4245; H01J 49/4255
USPC ..... 250/281, 282, 283, 290, 286, 293
See application file for complete search history.

(56) References Cited

U.S. PATENT DOCUMENTS

| | | | | |
|---|---|---|---|---|
| 2009/0189067 | A1* | 7/2009 | Morrisroe ..... | H01J 49/067<br>250/282 |
| 2009/0261247 | A1 | 10/2009 | Cooks et al. | |
| 2010/0282963 | A1* | 11/2010 | Remes ..... | H01J 49/005<br>250/282 |

FOREIGN PATENT DOCUMENTS

| | | | |
|---|---|---|---|
| CN | 101794702 | A | 8/2010 |
| CN | 102832098 | A | 12/2012 |

* cited by examiner

TYPE RECTANGULAR ION TRAP DEVICE AND METHOD FOR ION STORAGE AND SEPARATION

TECHNICAL FIELD

The present invention relates to an ion trap mass analyzer in a mass spectrometer, and particularly, to a new type rectangular ion trap device and a method for ion storage and separation.

BACKGROUND

A mass spectrum analysis method is an analysis method for ionizing material particles (atoms or molecules) into ions, arranging them according to spatial position, time sequence or the like by a suitable stable or changeable electrical field or magnetic field to obtain a charge-to-mass ratio separation, and detecting their intensity for quantitative and qualitative analysis. As the mass spectrum analysis method detects the material particles directly and has characteristics of high sensitivity, high resolution, high flux and high applicability, the mass spectrometer and the mass spectrometric technique is significant in the modern science and technology. With the development of sciences, such as life science, environment science and medical science, and due to the requirements of food security, national security and international anti-terrorism, the mass spectrometer has been one of analyzers in the fastest-growing demand. Especially, when the chromatography-mass spectrometry linked technique and relevant instruments appear, they become very popular and even indispensable in the above fields since they have high separation function and high detection sensitivity to a complex matrix.

A mass analyzer is a component of mass spectrometer and used for separation of ions according to the mass to charge ratio. An ion trap is an important mass analyzer and has a principle of first storing ions in a trap and then separating the ions for detection. As compared with a mass analyzer without an ion trap, a mass analyzer with an ion trap can store ions, so an $MS^n$ operation (mass spectrometric operation) can be performed in the mass analyzer with an ion trap.

An ion trap has various structure like a traditional 3D ion trap, a linear ion trap made by an American company and a rectangular ion trap invented by a doctor in US, wherein the rectangular ion trap can overcome problems about small capacity of ion storage in the traditional 3D ion trap, high process complexity for the linear ion trap and so on.

An operation mode of an ion trap can be divided into two phases: an ion injection storage phase and an ion separation detection phase. In the ion injection storage phase, it requires ions as much as possible within a unit time, thereby obtaining an ion detection signal with high intensity.

An operation mode of a rectangular ion trap in the ion injection storage phase is provided as follows: an ion (with positive charge, for example) having a certain speed enters the ion trap via a central hole or gap of a front end cover (in this stage, the front end cover is negatively charged to attract the ion with positive charge, so that the ion with positive charge enters the ion trap), and moves at a high speed under the effect of a radio frequency electrical field;

when the ion with positive charge moves close to a rear end cover, the rear end cover (in this stage the rear end cover is positively charged) repels the ion with positive charge to a center of the ion trap; when the ion with positive charge moves from the center of the ion trap to the front end cover, due to the attraction of the front end cover, the ion with positive charge is generally drawn out of the ion trap and impacted on an electrode sheet when it enters the ion trap once again, so buffer gas is generally injected into the ion trap and used to impact the ion with positive charge so as to reduce the kinetic energy of the ion with positive charge; accordingly, it can reduce the possibility of the ion with positive charge entering the ion trap and then drawn out.

However, when the buffer gas is less, it is not enough to reduce the kinetic energy of the ion with positive charge, and hence the number of ions with positive charge out of the ion trap is largely increased; but if the buffer gas is too much, although it can store more ions with positive charge within a unit time, it destroys the basic requirement of the detection system on the vacuum degree and affects the operation of the ion separation detection in the next phase. Accordingly, it generally injects a balanced flow rate of buffer gas to balance both the ion injection and the ion detection, but either the ion injection or the ion detection is hard to reach to a high property.

According to experiments and simulations, it shows that the rectangular ion trap in the prior art has a phenomenon that an ion enters the ion trap and then gets out of the ion trap in the ion injection storage phase. The phenomenon reduces the number of ions in storage within a unit time and affects detection effect, particularly the detection on a low abundance of ions, but a characteristic component in a complex sample is generally an ion in a low abundance. At present, the detection on a characteristic component in a complex sample tends to accurately detect the characteristic component in the complex sample quantitatively and qualitatively.

In U.S. Pat. No. 6,838,666, a new geometry ion trap and its use as a mass spectrometer is described. The ion traps can be combined linearly and in parallel to form systems for mass storage, analysis, fragmentation, separation, etc. of ions. The ion trap has a simple rectilinear geometry with a high trapping capacity. It can be operated to provide mass analysis in the mass-selective instability mode as well as the mass-selective stability mode. Arrays of multiple ion traps allow combinations of multiple gas-phase processes to be applied to the trapped ions to achieve high sensitivity, high selectivity and/or higher throughput in the process of ion analysis.

SUMMARY OF INVENTION

In order to solve the above problem, the present invention provides a new type rectangular ion trap device and a method for ion storage and separation.

In order to achieve the above purpose, the present invention provides a new type rectangular ion trap device comprising a front end cover, a middle portion, and a rear end cover, characterized in that the front end cover includes a front end cover left electrode, a front end cover middle layer insulator, and a front end cover right electrode, wherein the front end cover left electrode and the front end cover right electrode are respectively positioned at both sides of the front end cover middle layer insulator, and a central position of the front end cover is penetrated; when the ion trap stays in an ion injection storage phase, the front end cover is used to attract an ion to be stored into the ion trap; when the ion trap stays in an ion separation detection phase, the front end cover is used to prevent ions outside the ion trap, which have the same electrical property as the ion inside the ion trap, from entering the ion trap, prevent the escape of the ion inside the ion trap from the front end cover, and also press the ion inside the ion trap to the center of the ion trap.

The rear end cover is configured as an electrode, wherein the rear end cover has the same axis as the front end cover, and the central position of the rear end cover electrode is penetrated; when the ion trap stays in the ion injection storage phase, the rear end cover is used to prevent the escape of the ion to be storage from the rear end cover and also press the ion inside the ion trap to the center of the ion trap.

The middle portion comprises a front electrode, a rear electrode, an upper electrode and a lower electrode, wherein the front and rear electrodes and the upper and lower electrodes are symmetric along the axis of the front end cover, and these electrodes form a space region for ion storage or separation about the axis between the front end cover and the rear end cover electrode.

In the new type rectangular ion trap device, a distance between the front end cover left electrode and front end cover right electrode and the front end cover middle layer insulator is less than or equal to 0.5 mm.

In the new type rectangular ion trap device, the distance between the front end cover and the space region is equal to the distance between the rear end cover and the space region.

In the new type rectangular ion trap device, gaps are configured to penetrate central positions of the front electrode and the rear electrode, respectively.

The present invention also provides a method for storing and separating ions by using the above ion trap, comprising:

An ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover to prevent the escape of the ion to be stored from the rear end cover.

An ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage identical to the having an electrical property identical to the ion inside the ion trap is applied to the rear end cover to prevent the escape of the ion inside the ion trap from the rear end cover and also press the ion inside the ion trap to the center of the ion trap.

The method for ion storage and separation, the ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

The new type rectangular ion trap, the ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

The present invention also provides another new type rectangular ion trap device comprising a front end cover, a middle portion, and a rear end cover, characterized in that the front end cover includes a front end cover left electrode, a front end cover middle layer insulator, and a front end cover right electrode, wherein the front end cover left electrode and the front end cover right electrode are respectively positioned at both sides of the front end cover middle layer insulator, and a central position of the front end cover is penetrated; when the ion trap stays in an ion injection storage phase, the front end cover is used to attract an ion to be stored into the ion trap; when the ion trap stays in an ion separation detection phase, the front end cover is used to prevent ions outside the ion trap, which have the same electrical property as the ion inside the ion trap, from entering the ion trap, prevent the escape of the ion inside the ion trap from the front end cover, and also press the ion inside the ion trap to the center of the ion trap.

the rear end cover includes a rear end cover left electrode, a rear end cover middle layer insulator, and a rear end cover right electrode, wherein the rear end cover left electrode and the rear end cover right electrode are respectively positioned at both sides of the rear end cover middle layer insulator; the rear end cover has the same axis as the front end cover; and a central position of the rear end cover is penetrated; when the ion trap stays in an ion injection storage phase, the rear end cover is used to prevent the escape of the ion inside the ion trap from the rear end cover, and also reduce the kinetic energy of the ion to be stored.

The middle portion comprises a front electrode, a rear electrode, an upper electrode and a lower electrode, wherein the front and rear electrodes and the upper and lower electrodes are symmetric along the axis of the front end cover, and these electrodes form a space region for ion storage or separation about the axis between the front end cover and the rear end cover electrode.

In the new type rectangular ion trap device, a distance between the front end cover left electrode and front end cover right electrode and the front end cover middle layer insulator is less than or equal to 0.5 mm; a distance between the rear end cover left electrode and rear end cover right electrode and the rear end cover middle layer insulator is less than or equal to 0.5 mm;

In the new type rectangular ion trap device, the distance between the front end cover and the space region is equal to the distance between the rear end cover and the space region.

In the new type rectangular ion trap device, gaps are configured to penetrate central positions of the front electrode and the rear electrode, respectively.

According to the second new type ion trap, the present invention provides a method for storing and separating ions, comprising:

An ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover left electrode to prevent the escape of the ion to be stored from the rear end cover; a voltage having an electrical property opposite to an ion to be stored is applied to the rear end cover right electrode to reduce the kinetic energy of the ion to be stored.

An ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage identical to the having an electrical property identical to the ion inside the ion trap is applied to the rear end cover left electrode and rear end cover right electrode respectively to prevent the escape of the ion inside the ion trap from the rear end cover and also press the ion inside the ion trap to the center of the ion trap.

The method for ion storage and separation, the ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

The method for ion storage and separation, the ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

The present invention can effectively reduce the possibility of the ion drawn out of the front end cover after entering the ion trap to increase the number of ions in storage within a unit time prominently in the ion injection and storage phase, press the ion to the center of the ion trap by adjusting the voltages of the front and rear end covers to concentrate ion cloud and facilitate detection so as to enhance signal intensity and resolution ratio for ion detection in the ion separation detection phase. A mass spectrometer having the new type rectangular ion trap as a mass analyzer has a better ion storage efficiency and a better analysis property, and the ion trap inherits the characteristics about simple processing of the rectangular ion trap, overcomes the shortage of the ion injection storage efficiency, and can be used as a widely used mass analysis.

Figure 1:
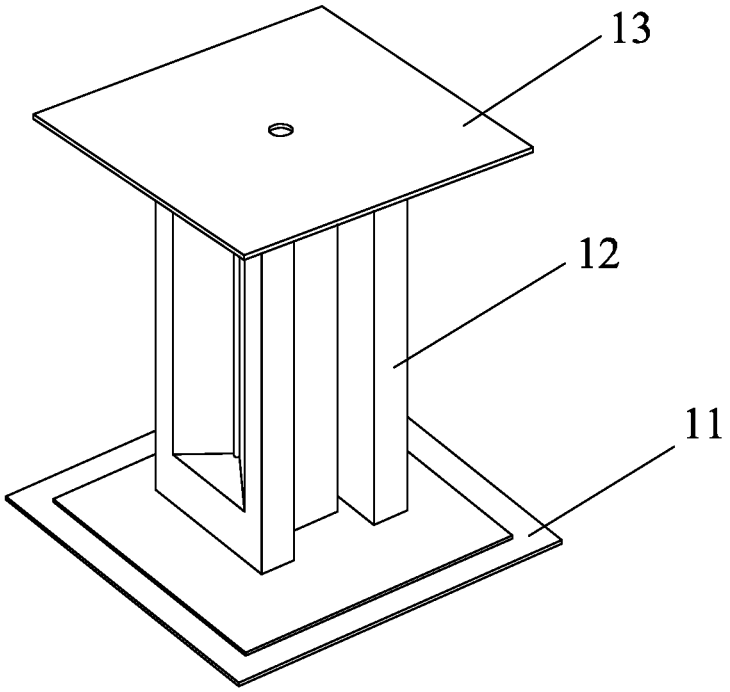
FIG. 1 is a view showing a new type rectangular ion trap device having a specific front end cover.

Wherein, the drawing references signs are:

11 is a front end cover;
12 is a middle portion;
13 is a rear cover;
100 is a front end cover left electrode;
110 is a front end cover middle layer insulator;
12 is a front end cover right electrode;
101, 111 and 121 are circular holes on 100, 110 and 120;
130 is a front electrode;
140 is a rear electrode;
150 is an upper electrode;
160 is a lower electrode;
131 is a gap on 130 and 140;

The above drawing reference signs are drawing reference signs of a new type rectangular ion trap device having a specific front end cover;

The following drawing reference signs are drawing reference signs of a new type rectangular ion trap device having specific front and rear end covers:

400 is a is a front end cover left electrode;
410 is a front end cover middle layer insulator;
420 is a front end cover right electrode;
401, 400 and 421 are circular holes of 400, 410 and 420;
430 is a front electrode;
440 is a rear electrode;
450 is an upper electrode;
460 is a lower electrode;
431 is a gap on 430 and 440;
470 is a rear end cover left electrode;
480 is a rear end cover middle layer insulator;

490 is a rear end cover right electrode;

470, 481 and 491 are circular holes of 470, 480 and 490.

DETAILED DESCRIPTION OF THE INVENTION

As illustrated in FIG. 1, the new type rectangular ion trap device of the present invention comprises a front end cover 11, a middle portion 12, and a rear end cover 13, wherein the middle portion 12 is disposed between the front end cover 11 and rear end cover 13; the front end cover 11, the middle portion 12 and the rear end cover 13 have the same axis; the middle portion 12 has a distance from the front end cover 11 and rear end cover 13, and the distance is about 2 mm.

Figure 2A:
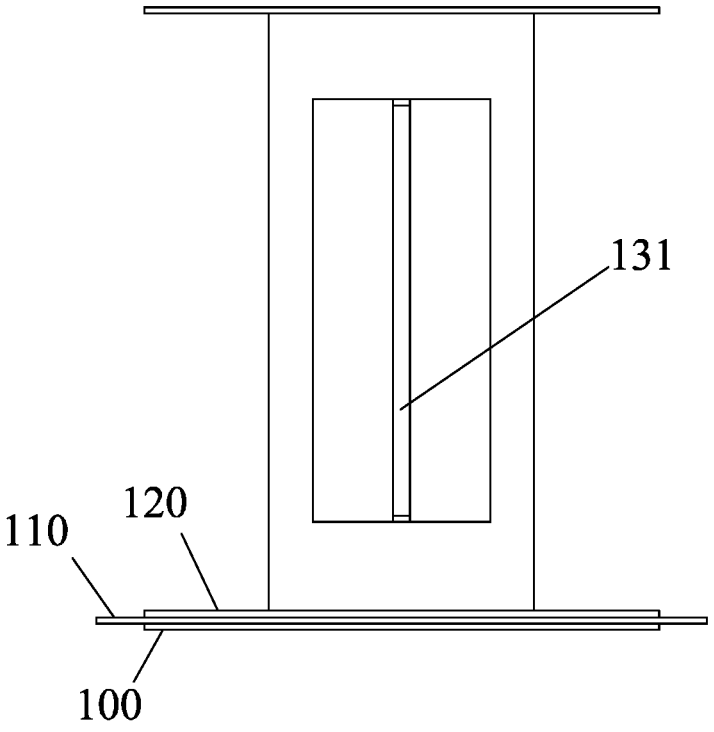
FIG. 2*a* is a bottom view showing a new type rectangular ion trap device having a specific front end cover.
Figure 2B:
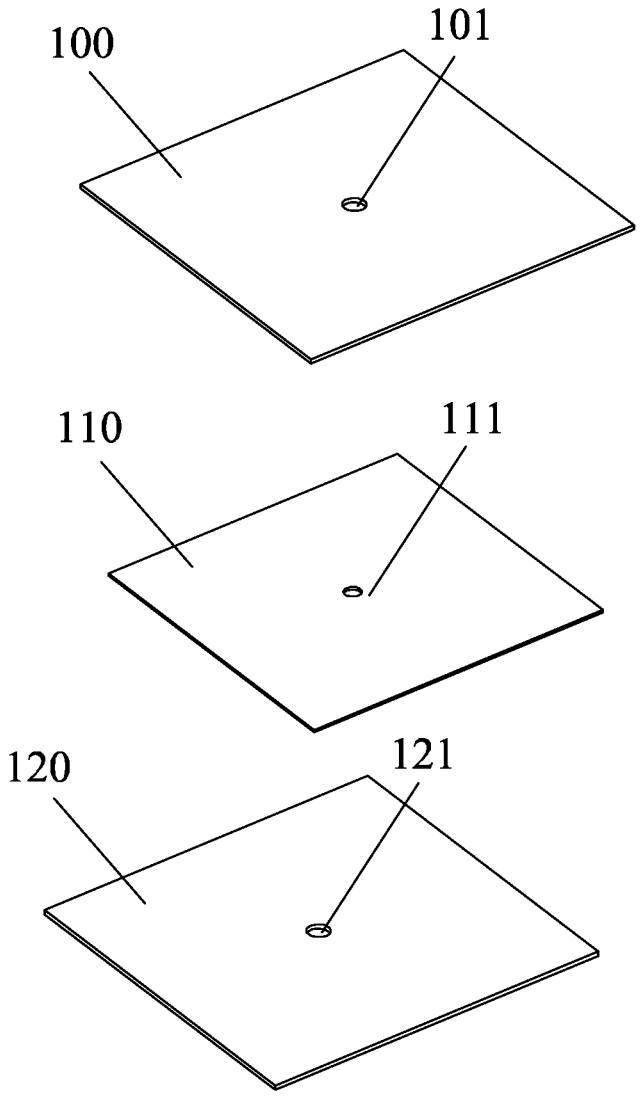
FIG. 2*b* is a structural view showing a specific front end cover of a new type rectangular ion trap device having the specific front end cover.
Figure 2C:
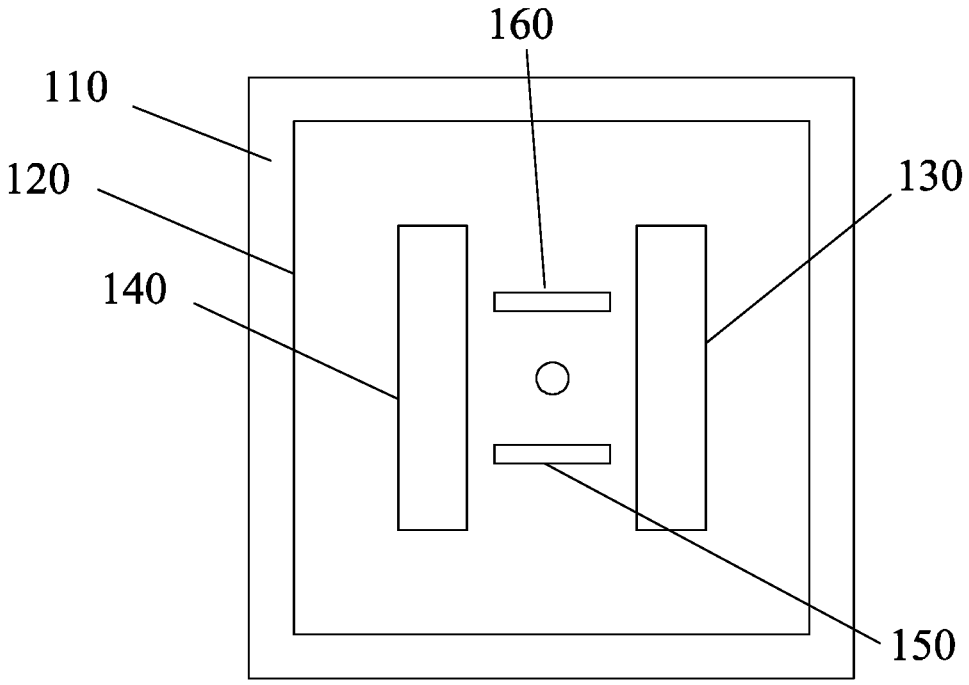
FIG. 2*c* is an inside view showing a new type rectangular ion trap device having a specific front end cover.

As illustrate in FIGS. 2*a*, 2*b* and 2*c*, the front end cover 11 includes a front end cover left electrode 100, a front end cover middle layer insulator 110, a front end cover right electrode 120, wherein the central position of the front end cover 11 is a circular hole (a circular hole is used as an example, it may also be a ellipse or a gap, which is not limited in the invention), i.e., the front end cover left electrode 100 comprises a circular hole 101 disposed in the central position; the front end cover middle layer insulator 110 comprises a circular hole 111 disposed in the central position; the front end cover right electrode 120 comprises a circular hole 121 disposed in the central position; these circular holes are positioned in the same axis; the middle portion 12 comprises a front electrode 130, a rear electrode 140, an upper electrode 150 and a lower electrode 160, wherein the rear end cover 13 comprises a rear end cover electrode 170 having a central position as a circular hole (a circular hole is used as an example, it may also be a ellipse or a gap, which is not limited in the invention); except the front end cover middle layer insulator 110, all the other components may be conductive; the front end cover left electrode 100 and the front end cover right electrode 120 have the same shape and are attached to both sides of the front end cover middle layer insulator 110 tightly; the front end cover middle layer insulator 110 is required to be very thin, generally no more than 0.5 mm. The front end cover right electrode 120 and the rear end cover electrode 170 have the same distance to the middle portion 12, and the distance is small, about 2 mm.

As illustrated in FIGS. 2*a* and 2*c*, the front electrode 130 and the rear electrode 140 are symmetric along the axis of the middle portion 12; the upper electrode 150 and the lower electrode 160 are symmetric along the axis of the middle portion 12; a rectangle is formed by the surrounding of the front electrode 130, the rear electrode 140, the upper electrode 150 and the lower electrode 160, and the front electrode 130 and the rear electrode 140 include a pair of very narrow and symmetric gaps 131 for ejection and detection of separated ions.

A direct voltage DC1 is applied to the front end cover left electrode 100; a direct voltage DC2 is applied to the front end cover right electrode 120; a direct voltage DC3, an alternating voltage AC1 and meanwhile a radio frequency voltage RF2 are applied to the front electrode 130 and the rear electrode 140; a direct voltage DC3 and a radio frequency voltage RF1 (RF1 and RF2 have the same voltage amplitude and frequency) are applied to the upper electrode 150 and the lower electrode 160; a direct voltage DC4 is applied to the rear end cover electrode 170.

Function of the front end cover middle layer insulator 110 is: first, to prevent an electrical field of the front end cover right electrode 120 and an electrical field inside the new type ion trap from affecting ion movement in a space to the left of the front end cover left electrode 100; second, to prevent an electrical field of the front end cover left electrode 100 from affecting ion movement inside the new type ion trap.

The particular steps for ion storage and separation by using the new type ion trap provided by the present invention are described as follows:

An ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover to prevent the escape of the ion to be stored from the rear end cover.

An ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage having an electrical property identical to the ion inside the ion trap is applied to the rear end cover to prevent the escape of the ion inside the ion trap from the rear end cover and also press the ion inside the ion trap to the center of the ion trap. (The method is written in the description).

The ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

The ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

Figure 3:
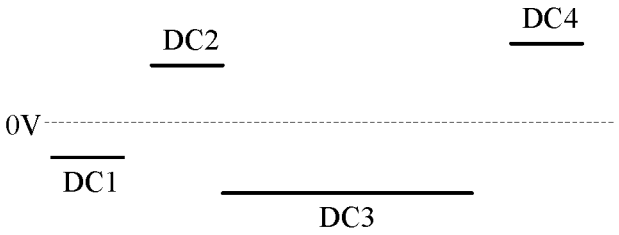
FIG. 3 is an operation view for a new type rectangular ion trap device having a specific front end cover in an ion injection storage phase.

As illustrated in FIG. 3, a positive ion is taken as an example, in the ion injection storage phase, the direct voltage DC1 applied to the front end cover left electrode 100 is a negative voltage to promote the positive ion to be injected to the new type ion trap; the a direct voltage DC2 applied to the front end cover right electrode 120 is a positive voltage to generate a little resistance for the injection of the positive ion, and the positive ion can be successfully injected by slightly increasing an initial velocity of the positive ion; the suitable positive voltage DC2 can effectively prevent the escape of the positive ion from the new type ion trap via the circular hole of the front end cover; a radio frequency voltage RF1 is applied to the upper electrode 150 and the lower electrode 160 and closely related to the charge-to-mass ratio of the ion to be stored, and the following formula can be taken for reference:

$$\frac{m}{e} = A_2 \frac{8V_{rf}}{q_x x_o^2 \omega^2} \quad \text{Eq. 1}$$

In Eq. 1, $V_{rf}$ is RF1, $A_2$ is a quadrupole field diffusion coefficient, $q_x$ is a Mathew equation parameter (generally no more than 0.8, to be about 0.3), $x_o$ is a distance between the central point and the front or rear in the space of the ion trap, ω is a frequency of the RF1.

A radio frequency voltage RF2 are applied to the front electrode 130 and the rear electrode 140 and has a phase opposite to the RF1, meanwhile, a direct voltage DC3 is a negative voltage applied to all of the front electrode 130, the rear electrode 140, the upper electrode 150 and the lower electrode 160 and used to bind the positive ion to let the positive ion move inside the new type ion trap as possible; a direct voltage DC4 is a positive voltage applied to the rear end cover electrode 170 and configured to prevent the escape of the positive ion with a certain kinetic energy via the circular hole of the rear end cover; but the DC4 should not be too high, or it will increase the possibility of the escape of the ion from the circular hole of the front end cover. The kinetic energy of the positive ion inside the new type ion trap mainly depends on an initial kinetic energy before the positive ion enters the new type ion trap, a voltage value of the DC1 and a voltage value of the DC3; the voltage DC4 is a main voltage for preventing the escape of the positive ion from the rear end cover electrode 170, and the voltage DC2 is a main voltage for preventing the escape of the ion from the front end cover 11.

Figure 4:
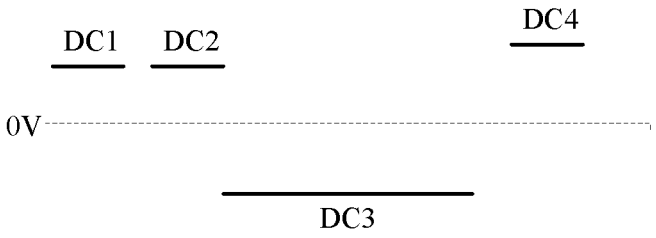
FIG. 4 is an operation view for a new type rectangular ion trap device having a specific front end cover in an ion separation detection phase.

As illustrated in FIG. 4, a positive ion is taken for example; in the ion separation and detection phase, a direct voltage DC1 is a positive voltage applied to the front end cover left electrode 100 and used to prevent the ion from entering the new type ion trap from the circular hole of the front end cover; a direct voltage DC2 is a positive voltage applied to the front end cover right electrode 120, used to prevent the escape of the ion from the front end cover and also used to press the positive ion to the center of the new type ion trap; a radio frequency voltage RF1 is applied to the upper electrode 150 and the lower electrode 160 and closely related to the charge-to-mass ratio of the ion to be stored, and the following formula can be taken for reference:

$$\frac{m}{e} = A_2 \frac{8V_{rf}}{q_x x_o^2 \omega^2} \quad \text{Eq. 1}$$

In Eq. 1, $V_{rf}$ is RF1, $A_2$ is a quadrupole field diffusion coefficient, $q_x$ is a Mathew equation parameter (generally no more than 0.8, to be about 0.3), $x_o$ is a distance between the central point and the front or rear in the space of the ion trap, ω is a frequency of the RF1.

A radio frequency voltage RF2 is applied to the front electrode 130 and the rear electrode 140 and has a phase opposite to the RF1, meanwhile, a direct voltage DC3 is a negative voltage applied to all of the front electrode 130, the rear electrode 140, the upper electrode 150 and the lower electrode 160 and used to bind the positive ion to let the positive ion move inside the new type ion trap as possible; a direct voltage DC4 is a positive voltage applied to the rear end cover electrode 170, used to prevent the escape of the ion from the circular hole of the rear end cover electrode 170 and also used to press the positive ion to the center of the new type ion trap; in the ion separation detection phase, the voltage value of DC2 is equal to the voltage value of DC4; an alternating voltage AC1 is applied to the front electrode 130 and the rear electrode 140; a radio frequency voltage RF1 is applied to the upper electrode 150 and the lower electrode 160 (a radio frequency voltage RF2 is applied to electrodes on the front electrode 130 and the rear electrode 140) and matched with the voltage AC1 of the front electrode 130 and the rear electrode 140 to eject ions from small to large order according to the charge-to-mass ratio from the gap 131 to the detector, so as to obtain quantitative and qualitative information by the detector.

Figure 5:
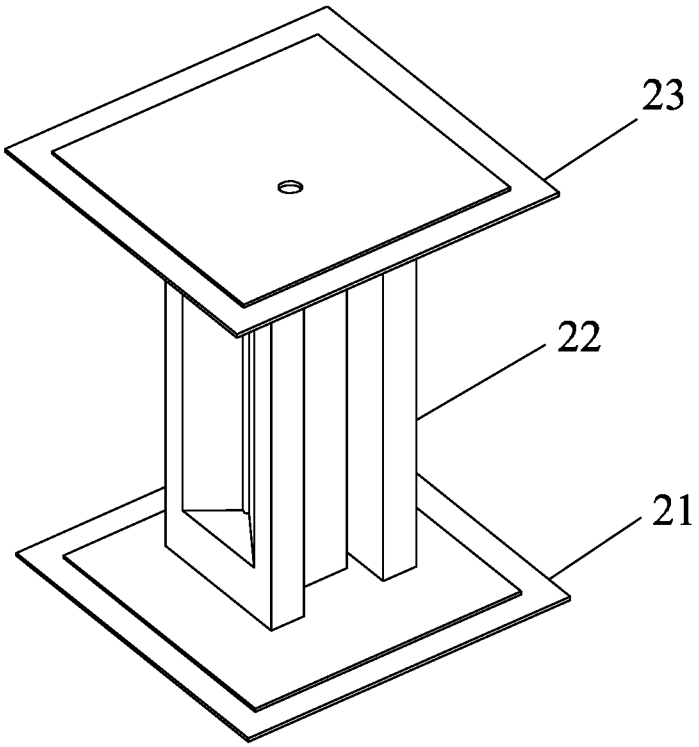
FIG. 5 is a view showing a new type rectangular ion trap device having specific front and rear end covers.

Another embodiment is provided as follows:

As illustrated in FIG. 5, the new type rectangular ion trap device of the present invention comprises a front end cover 21, a middle portion 22, and a rear end cover 23, wherein the middle portion 22 is disposed between the front end cover 21 and rear end cover 23; the front end cover 21, the middle portion 22 and the rear end cover 23 have the same axis; the middle portion 22 has a distance from the front end cover 21 and rear end cover 23, and the distance is about 2 mm.

Figure 6A:
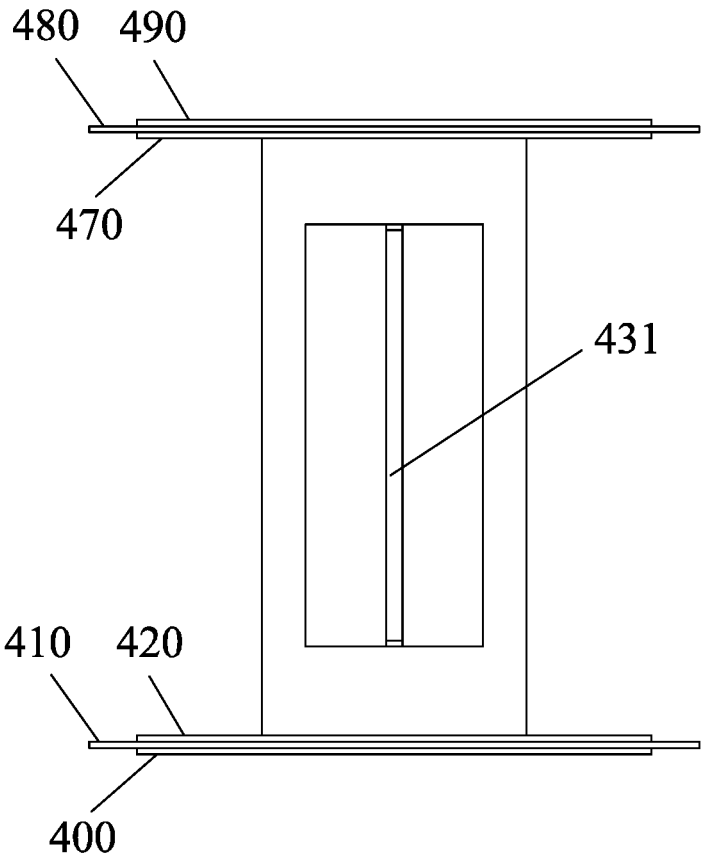
FIG. 6*a* is a bottom view showing a new type rectangular ion trap device having specific front and rear end covers.
Figure 6B:
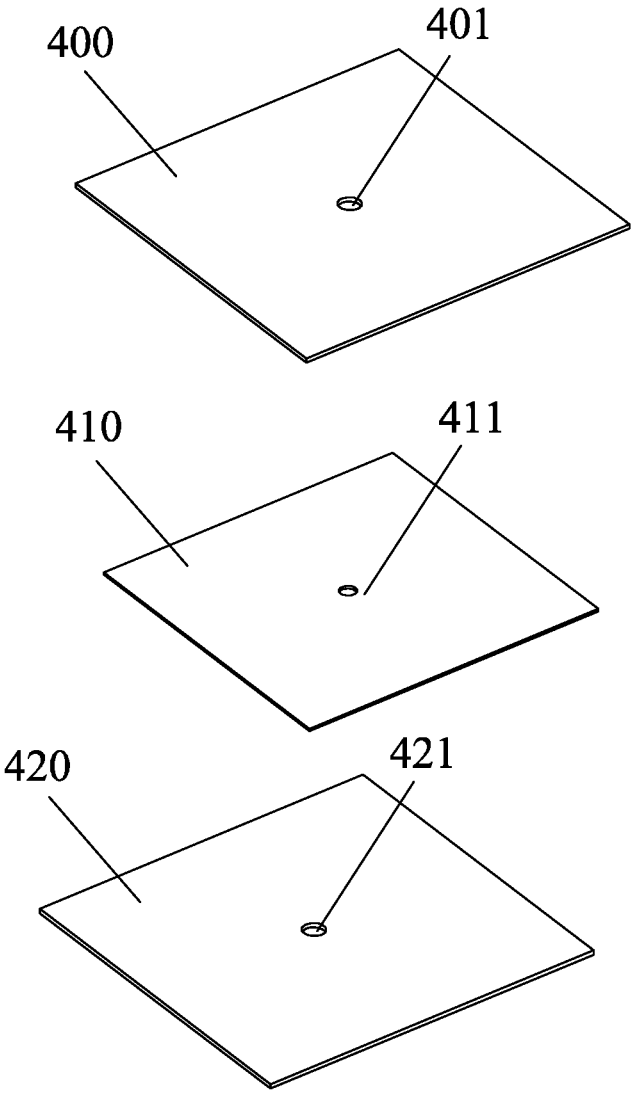
FIG. 6*b* is a structural view showing a specific front end cover of a bottom view showing a new type rectangular ion trap device having specific front and rear end covers.
Figure 6C:
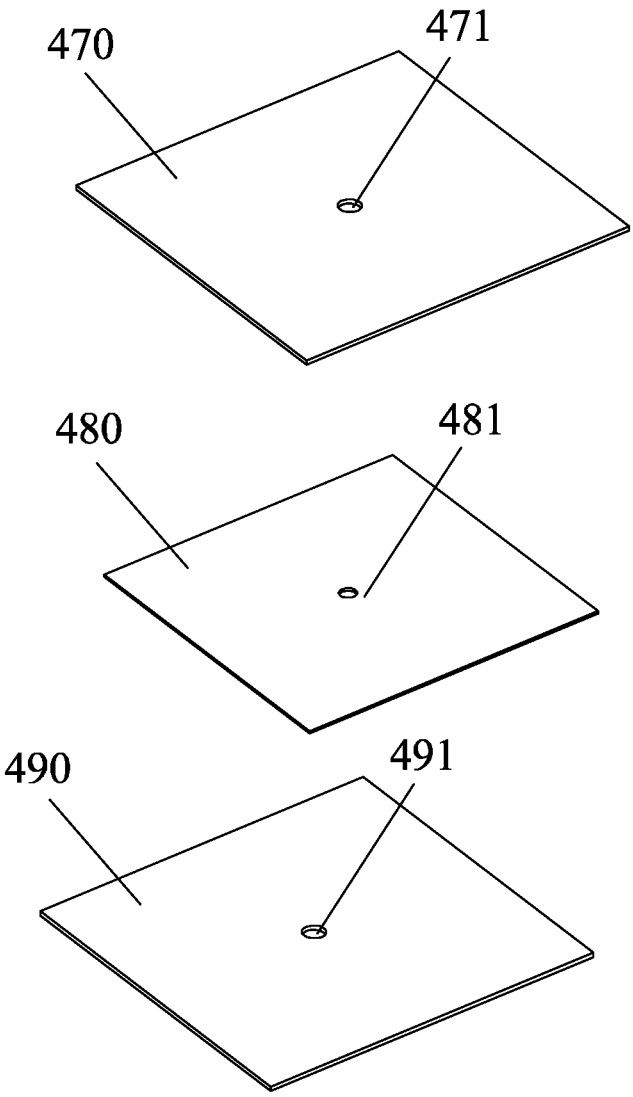
FIG. 6*c* is a structural view showing a specific rear end cover of a bottom view showing a new type rectangular ion trap device having specific front and rear end covers.
Figure 6D:
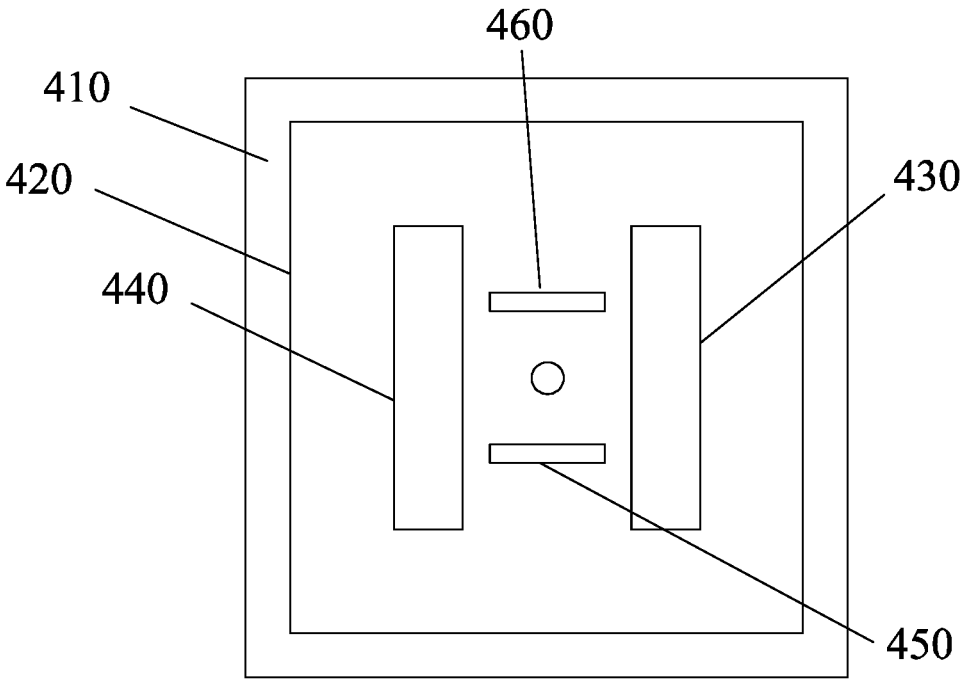
FIG. 6*d* is an inside view showing a new type rectangular ion trap device having specific front and rear end covers.

As illustrated in FIGS. 6*a*, 6*b*, 6*c* and 6*c*, the front end cover 21 includes a front end cover left electrode 400, a front end cover middle layer insulator 410, a front end cover right electrode 420, wherein the central position of the front end cover 21 is a circular hole (a circular hole is used as an example, it may also be a ellipse or a gap, which is not limited in the invention), i.e., the front end cover left electrode 400 comprises a circular hole 401 disposed in the central position; the front end cover middle layer insulator 410 comprises a circular hole 411 disposed in the central position; the front end cover right electrode 420 comprises a circular hole 421 disposed in the central position; these circular holes are positioned in the same axis; the middle portion 22 comprises a front electrode 430, a rear electrode 440, an upper electrode 450 and a lower electrode 460; the rear end cover 23 comprises a rear end cover left electrode 470, a rear end cover middle layer insulator, and a rear end cover right electrode 490, wherein a central position of the rear end cover 23 is a circular hole (a circular hole is used as an example, it may also be a ellipse or a gap, which is not limited in the invention), i.e., the rear end cover left electrode 470 comprises a circular hole 471 disposed in the central position; the rear end cover middle layer insulator 480 comprises a circular hole 481 disposed in the central position; the rear end cover right electrode 490 comprises a circular hole 491 disposed in the central position; these circular holes are positioned in the same axis; except the front end cover middle layer insulator 110 and the rear end cover middle layer insulator 480 which are insulators and have the same shape, all the other components may be conductive; the front end cover left electrode 100, the front end cover right electrode 120, the rear end cover left electrode 470 and the rear end cover right electrode 490 have the same shape and are attached to both sides of the front end cover middle layer insulator 110 and the end cover middle layer insulator 480 respectively; the front end cover middle layer insulator 110 and the end cover middle layer insulator 480 are required to be very thin, generally no more than 0.5 mm; the front end cover right electrode 120 and the rear end cover left electrode 470 have the same distance to the middle portion 22, and the distance is small, about 2 mm.

As illustrated in FIGS. 6*a* and 6*c*, the front electrode 430 and the rear electrode 440 are symmetric along the axis of the middle portion 22; the upper electrode 450 and the lower electrode 460 are symmetric along the axis of the middle portion 22; a rectangle is formed by the surrounding of the front electrode 430, the rear electrode 440, the upper electrode 450 and the lower electrode 460, and the front electrode 430 and the rear electrode 440 include a pair of very narrow and symmetric gaps 431 for ejection and detection of separated ions.

As illustrated in FIGS. 2*a* and 2*c*, the front electrode 130 and the rear electrode 140 are symmetric along the axis of the middle portion 12; the upper electrode 150 and the lower electrode 160 are symmetric along the axis of the middle portion 12; a rectangle is formed by the surrounding of the front electrode 130, the rear electrode 140, the upper electrode 150 and the lower electrode 160, and the front electrode 130 and the rear electrode 140 include a pair of very narrow and symmetric gaps 131 for ejection and detection of separated ions.

A direct voltage DC1 is applied to the front end cover left electrode 400; a direct voltage DC2 is applied to the front end cover right electrode 420; a direct voltage DC3, an alternating voltage AC1 and meanwhile a radio frequency voltage RF2 are applied to the front electrode 130 and the rear electrode 440; a direct voltage DC3 and a radio frequency voltage RF1 (RF1 and RF2 have the same voltage amplitude and frequency) are applied to the upper electrode 450 and the lower electrode 460; a direct voltage DC4 is applied to the rear end cover electrode 470; a direct voltage DC5 is applied to the rear end cover right electrode 490.

The function of the front end cover middle layer insulator 410 is: first, to prevent an electrical field of the front end cover right electrode 420 and an electrical field inside the ion trap from affecting a space to the left of the front end cover left electrode 400; second, to prevent an electrical field of the front end cover left electrode 410 from affecting a space inside the new type ion trap; and the rear end cover middle layer insulator 480 has the same function as the front end cover middle layer insulator 410.

The particular steps for ion storage and separation by using the new type ion trap provided by the present invention are provided as follows:

An ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover left electrode to prevent the escape of the ion to be stored from the rear end cover; a voltage having an electrical property opposite to an ion to be stored is applied to the rear end cover right electrode to reduce the kinetic energy of the ion to be stored;

An ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage having an electrical property identical to the ion inside the ion trap is applied to the rear end cover left electrode and rear end cover right electrode respectively to prevent the escape of the ion inside the ion trap from the rear end cover and also press the ion inside the ion trap to the center of the ion trap.

The ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

The ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

Figure 7:
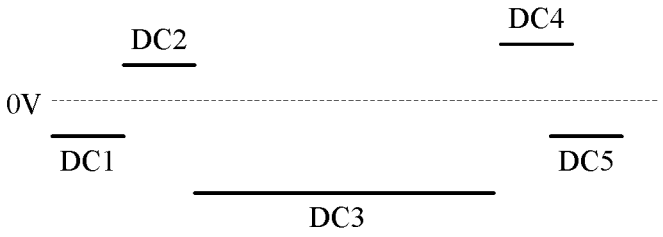
FIG. 7 is an operation view for a new type rectangular ion trap device having specific front and rear end covers in an ion injection storage phase.

As illustrated in FIG. 7, a positive ion is taken as an example, in the ion injection storage phase, the direct voltage DC1 applied to the front end cover left electrode 400 is a negative voltage to inject the positive ion into the new type ion trap; the a direct voltage DC2 applied to the front end cover right electrode 420 is a positive voltage to generate a little resistance for the injection of the positive ion, and the positive ion can be successfully injected by slightly increasing an initial velocity of the positive ion; the suitable positive voltage DC2 can effectively prevent the escape of the positive ion from the new type ion trap via the circular hole of the front end cover; a radio frequency voltage RF1 is applied to the upper electrode 4150 and the lower electrode 460 and closely related to the charge-to-mass ratio of the ion to be stored, and the following formula can be taken for reference:

$$\frac{m}{e} = A_2 \frac{8V_{rf}}{q_x x_o^2 \omega^2} \qquad \text{Eq. 1}$$

In Eq. 1, $V_{rf}$ is RF1, $A_2$ is a quadrupole field diffusion coefficient, $q_x$ is a Mathew equation parameter (generally no more than 0.8, to be about 0.3), $x_o$ is a distance between the central point and the front or rear in the space of the ion trap, ω is a frequency of the RF1.

A radio frequency voltage RF2 are applied to the front electrode 430 and the rear electrode 440 and has a phase opposite to the RF1, meanwhile, a direct voltage DC3 is applied to all of the front electrode 430, the rear electrode 440, the upper electrode 450 and the lower electrode 460 and used to bind the positive ion to let the positive ion move inside the new type ion trap as possible; a direct voltage DC4 is a positive voltage applied to the rear end cover left electrode 480 and configured to prevent the escape of the positive ion with a certain kinetic energy via the circular hole of the rear end cover; but the DC4 should not be too high, or it will increase the possibility of the escape of the positive ion from the circular hole of the front end cover; a direct voltage DC5 is a negative voltage applied to the rear end cover right electrode 490 and used to reduce kinetic energy of the positive ion; the kinetic energy of the positive ion inside the new type ion trap mainly depends on an initial kinetic energy before the positive ion enters the new type ion trap, a voltage value of he DC1 and a voltage value of the DC3;

The voltage DC4 is a main voltage for preventing the escape of the positive ion from the rear end cover 23, and the voltage DC2 is a main voltage for preventing the escape of the ion from the front end cover 21.

Figure 8:
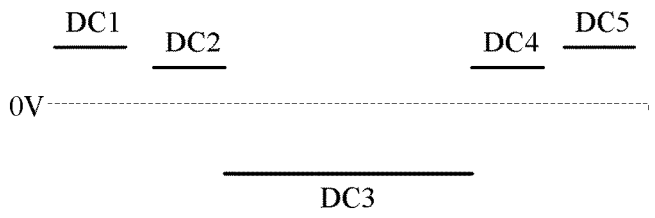
FIG. 8 is an operation view for a new type rectangular ion trap device having specific front and rear end covers in an ion separation detection phase.

As illustrated in FIG. 8, a positive ion is taken for example; in the ion separation and detection phase, a direct voltage DC1 is a positive voltage applied to the front end cover left electrode 400 and used to prevent the ion from entering the new type ion trap from the circular hole of the front end cover; a direct voltage DC2 is a positive voltage applied to the front end cover right electrode 420, used to prevent the escape of the ion from the front end cover and also used to press the ion to the center of the new type ion trap; a radio frequency voltage RF1 is applied to the upper electrode 450 and the lower electrode 460 and closely related to the charge-to-mass ratio of the ion to be stored, and the following formula can be taken for reference:

$$\frac{m}{e} = A_2 \frac{8V_{rf}}{q_x x_o^2 \omega^2} \qquad \text{Eq. 1}$$

In Eq. 1, $V_{rf}$ is RF1, $A_2$ is a quadrupole field diffusion coefficient, $q_x$ is a Mathew equation parameter (generally no more than 0.8, to be about 0.3), $x_o$ is a distance between the central point and the front or rear in the space of the ion trap, ω is a frequency of the RF1.

A radio frequency voltage RF2 is applied to the front electrode 430 and the rear electrode 440 and has a phase opposite to the RF1, meanwhile, a direct voltage DC3 is applied to all of the front electrode 430, the rear electrode 440, the upper electrode 450 and the lower electrode 460 and used to bind the positive ion to let the positive ion move inside the new type ion trap as possible; a direct voltage DC4 is a positive voltage applied to the rear end cover left electrode 470, used to prevent the escape of the ion from the circular hole of the rear end cover electrode 170 and also used to press the positive ion to the center of the new type ion trap; in the ion separation detection phase, the voltage value of DC2 is equal to the voltage value of DC4; a direct voltage DC5 is a positive voltage applied to the rear end cover right electrode 490; an alternating voltage AC1 is applied to electrodes of the front electrode 430 and the rear electrode 440; a radio frequency voltage RF1 is applied to electrodes of the upper electrode 450 and the lower electrode 460 (a radio frequency voltage RF2 is applied to electrodes in X axis direction) and matched with the alternating voltage AC1 of the front electrode 430 and the rear electrode 440 to eject ions from small to large order according to the charge-to-mass ratio from the gap 431 to the detector, so as to obtain quantitative and qualitative information.

DC1 and DC5 are both positive voltages that are beneficial to correct an electrical defect generated by circular holes of front and rear end covers, more beneficial to press the positive ion to the center of the new type ion trap for ion concentration, and beneficial to obtain a higher signal intensity and a better mass resolution.

Figure 9:
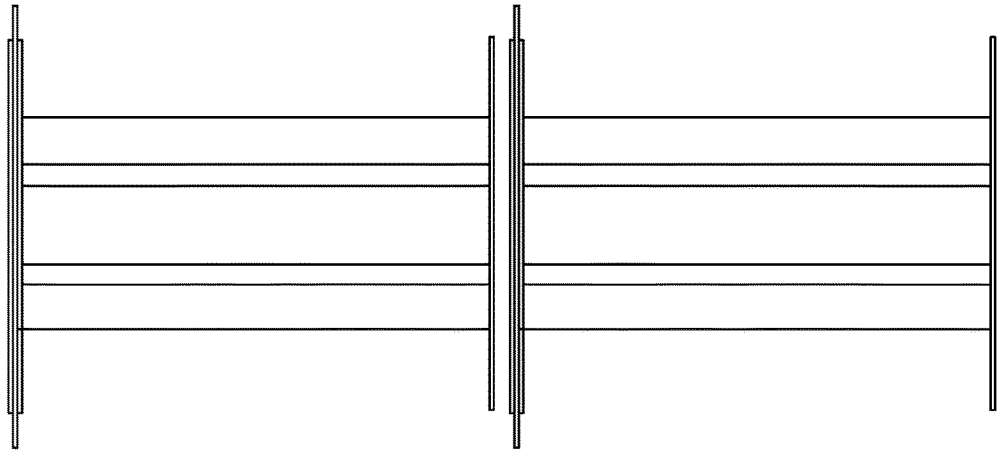
FIG. 9 is a view showing that two new type rectangular ion trap devices having specific front end covers are connected together.

FIG. 9 is a view showing a series system for new type rectangular ion traps having specific front end covers. As shown, the new type rectangular ion traps having specific front end covers are connected in series in the system. The distance between the two ion traps is from 2 mm to 10 mm. The specific front end cover of the first ion trap is used to increase the injection storage efficiency of the first ion trap, and the operation mode is similar to FIG. 3. The specific front end cover of the second ion trap is used to increase the injection storage efficiency from the first ion trap to the second ion trap, particularly, to reduce the possibility that an ion enters the second ion trap from the first ion trap and then returns to the first ion trap, and the operation mode of the second ion trap is similar to FIG. 3; wherein DC2 of the first ion trap is positive; DC3 is increased to be positive or zero; and DC4 is negative to induce the ion to the second ion trap. In the ion detection phase, the operation mode of the second ion trap is similar to FIG. 4.

Figure 10:
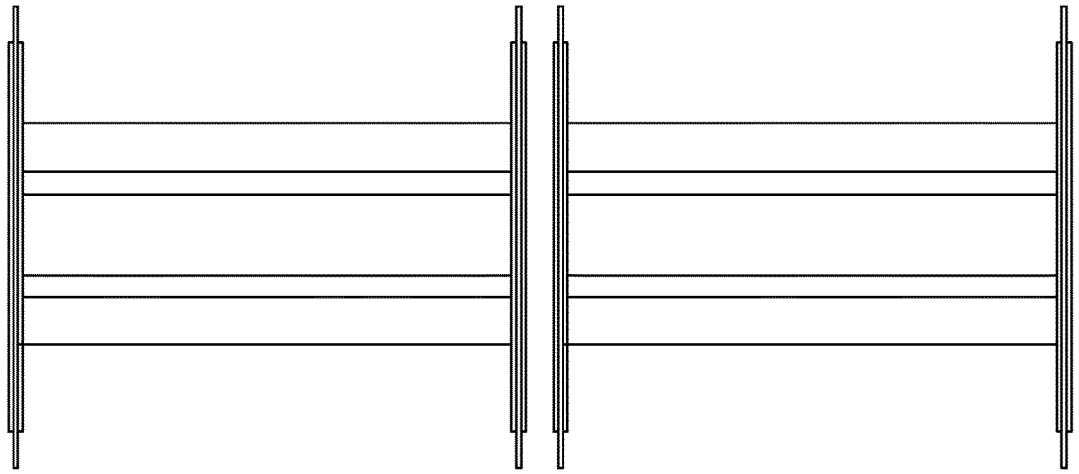
FIG. 10 is a view showing that two new type rectangular ion trap devices having specific front end covers are connected together.

FIG. 10 is a view showing a series system for new type rectangular ion traps having specific front and rear end covers. As shown, the new type rectangular ion traps having specific front and rear end covers are connected in series in the system. The distance between the two ion traps is from 2 mm to 10 mm. The specific front end cover of the first ion trap is used to increase the injection storage efficiency of the first ion trap, and the operation mode is similar to FIG. 7. The specific front end cover of the second ion trap is used to increase the injection storage efficiency from the first ion trap to the second ion trap, particularly, to reduce the possibility that an ion enters the second ion trap from the first ion trap and then returns to the first ion trap, and the operation mode of the second ion trap is similar to FIG. 7; wherein DC2 of the first ion trap is positive; DC3 is increased to be positive or zero; and DC4 and DC5 are negative to induce the ion to the second ion trap. In the ion detection phase, the operation mode of the second ion trap is similar to FIG. 8.

INDUSTRIAL APPLICABILITY

The present invention provides a new type rectangular ion trap mass analyzer having a specific front end cover and a method for operating the same, and relative to a rectangular ion trap with traditional structure, it has the following advantages and applicability:

1. It can prominently increase the ion storage efficiency (i.e., to increase the number of ions in storage within a unit time): in one aspect, it requires a shorter time for effectively storing the same number of ions, increases the analysis speed and can obtain more information of mass spectrometry within a unit time; in another aspect, it has great significance for storing rare ion (i.e., an ion in a low abundance), and the increased ion storage efficiency can effectively enhance the storage capacity of rare ion and provide a possibility for rare ion detection.

2. In the ion detection phase, the specific double end covers overcome the electrical field defect caused by the circular holes of end covers, and it can effectively press the ion to the center to increase the ion separation property, i.e., to increase the mass resolution and the signal intensity.

When the ion trap is applied for a traditional mass spectrum analysis, it has a faster speed, a better mass resolution and a better signal detection intensity; and when the ion trap is applied for a mass spectrum analysis of rare ion (i.e., an ion in a low abundance) in a complex matrix, it has a lower detection limitation and better analysis property.

Therefore, the trap ion inherits the characteristics about simple processing of the rectangular ion trap, overcomes the shortage of the ion injection storage efficiency, increase the analysis property, and can be used as a widely used mass spectrum analyzer.

The invention claimed is:

1. A new type rectangular ion trap device comprising a front end cover, a middle portion, and a rear end cover, wherein the front end cover includes a front end cover left electrode, a front end cover middle layer insulator, and a front end cover right electrode, wherein the front end cover left electrode and the front end cover right electrode are respectively positioned at both sides of the front end cover middle layer insulator, and a central position of the front end cover is penetrated; when the ion trap stays in an ion injection storage phase, the front end cover is used to attract an ion to be stored into the ion trap; when the ion trap stays in an ion separation detection phase, the front end cover is used to prevent ions outside the ion trap, which have the same electrical property as the ion inside the ion trap, from entering the ion trap, prevent the escape of the ion inside the ion trap from the front end cover, and also press the ion inside the ion trap to the center of the ion trap;

the rear end cover is configured as an electrode, wherein the rear end cover has the same axis as the front end cover, and the central position of the rear end cover electrode is penetrated; when the ion trap stays in the ion injection storage phase, the rear end cover is used to prevent the escape of the ion to be storage from the rear end cover and also press the ion inside the ion trap to the center of the ion trap;

the middle portion comprises a front electrode, a rear electrode, an upper electrode and a lower electrode, wherein the front and rear electrodes and the upper and lower electrodes are symmetric along the axis of the front end cover, and these electrodes form a space region for ion storage or separation about the axis between the front end cover and the rear end cover electrode.

2. The new type rectangular ion trap device according to claim 1, wherein a distance between the front end cover left electrode and front end cover right electrode and the front end cover middle layer insulator is less than or equal to 0.5 mm.

3. The new type rectangular ion trap device according to claim 1, wherein the distance between the front end cover and the space region is equal to the distance between the rear end cover and the space region.

4. The new type rectangular ion trap device according to claim 1, wherein gaps are configured to penetrate central positions of the front electrode and the rear electrode, respectively.

5. A method for storing and separating ions by using the ion trap according to claim 1, comprising:

an ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover to prevent the escape of the ion to be stored from the rear end cover;

an ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage identical to the having an electrical property identical to the ion inside the ion trap is applied to the rear end cover to prevent the escape of the ion inside the ion trap from the rear end cover and also press the ion inside the ion trap to the center of the ion trap.

6. The method for storing and separating ions according to claim 5, wherein the ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

7. The new type rectangular ion trap according to claim 5, wherein the ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

8. A new type rectangular ion trap device, comprising a front end cover, a middle portion, and a rear end cover, wherein the front end cover includes a front end cover left electrode, a front end cover middle layer insulator, and a front end cover right electrode, wherein the front end cover left electrode and the front end cover right electrode are respectively positioned at both sides of the front end cover middle layer insulator, and a central position of the front end cover is penetrated; when the ion trap stays in an ion injection storage phase, the front end cover is used to attract an ion to be stored into the ion trap; when the ion trap stays in an ion separation detection phase, the front end cover is used to prevent ions outside the ion trap, which have the same electrical property as the ion inside the ion trap, from entering the ion trap, prevent the escape of the ion inside the ion trap from the front end cover, and also press the ion inside the ion trap to the center of the ion trap;

the rear end cover includes a rear end cover left electrode, a rear end cover middle layer insulator, and a rear end cover right electrode, wherein the rear end cover left electrode and the rear end cover right electrode are respectively positioned at both sides of the rear end cover middle layer insulator; the rear end cover has the same axis as the front end cover; and a central position of the rear end cover is penetrated; when the ion trap stays in an ion injection storage phase, the rear end cover is used to prevent the escape of the ion inside the ion trap from the rear end cover, and also reduce the kinetic energy of the ion to be stored;

the middle portion comprises a front electrode, a rear electrode, an upper electrode and a lower electrode, wherein the front and rear electrodes and the upper and lower electrodes are symmetric along the axis of the front end cover, and these electrodes form a space region for ion storage or separation about the axis between the front end cover and the rear end cover electrode.

9. The new type rectangular ion trap device according to claim 8, wherein a distance between the front end cover left electrode and front end cover right electrode and the front end cover middle layer insulator is less than or equal to 0.5 mm; a distance between the rear end cover left electrode and rear end cover right electrode and the rear end cover middle layer insulator is less than or equal to 0.5 mm.

10. The new type rectangular ion trap device according to claim 8, wherein the distance between the front end cover and the space region is equal to the distance between the rear end cover and the space region.

11. The new type rectangular ion trap device according to claim 8, wherein gaps are configured to penetrate central positions of the front electrode and the rear electrode, respectively.

12. A method for storing and separating ions by using the ion trap according to claim 8, comprising:

an ion storage step, when the ion trap stays in a injection storage phase, a voltage having an electrical property opposite to an ion to be stored is applied to the front end cover left electrode to attract the ion to be stored into the ion trap; a voltage having an electrical property identical to the ion to be stored is applied to the front end cover right electrode to prevent the escape of the ion to be stored from the front end cover; a voltage identical to the having an electrical property identical to the ion to be stored is applied to the rear end cover left electrode to prevent the escape of the ion to be stored from the rear end cover; a voltage having an electrical property opposite to an ion to be stored is applied to the rear end cover right electrode to reduce the kinetic energy of the ion to be stored;

an ion separation step, when the ion trap stays in a separation detection phase, a voltage having an electrical property identical to the ion inside the ion trap is applied to the front end cover left electrode to prevent ions outside the ion trap, which have the same electrical property as the ion inside the ion trap, from entering the ion trap; a voltage having an electrical property identical to the ion inside the ion trap is applied to the front end cover right electrode to prevent the escape of the ion inside the ion trap from the front end cover and also press the ion inside the ion trap to the center of the ion trap; a voltage identical to the having an electrical property identical to the ion inside the ion trap is applied to the rear end cover left electrode and rear end cover right electrode respectively to prevent the escape of the ion inside the ion trap from the rear end cover and also press the ion inside the ion trap to the center of the ion trap.

13. The method for storing and separating ions according to claim 12, wherein the ion storage step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode respectively to restrict the movement of the ion to be stored in the ion trap.

14. The method for storing and separating ions according to claim 12, wherein the ion separation step further comprises: a radio frequency voltage is applied to the front electrode and the rear electrode; a radio frequency having a phase opposite to the radio frequency voltage applied by the front electrode and the rear electrode is applied to the upper electrode and the lower electrode; and meanwhile, a voltage having an electrical property opposite to the ion to be stored is applied to the front electrode, the rear electrode, the upper electrode and the lower electrode, respectively, and an AC voltage is applied to the front electrode and the rear electrode, so as to eject the ion inside the ion trap from the gap for detection.

* * * * *